US006991495B1

(12) United States Patent
Aromin

(10) Patent No.: US 6,991,495 B1
(45) Date of Patent: Jan. 31, 2006

(54) POWER STRIP WITH SELF-CONTAINED GROUND FAULT CIRCUIT INTERRUPTER MODULE

(75) Inventor: Victor V. Aromin, West Warwick, RI (US)

(73) Assignee: Tower Manufacturing Corporation, Providence, RI (US)

( * ) Notice: Subject to any disclaimer, the term of this patent is extended or adjusted under 35 U.S.C. 154(b) by 10 days.

(21) Appl. No.: 10/281,903

(22) Filed: Oct. 28, 2002

(51) Int. Cl.
*H01H 3/00* (2006.01)

(52) U.S. Cl. ..... 439/620; 361/42

(58) Field of Classification Search ..... 439/134–139, 439/145, 652, 650, 620, 107; 361/42, 45
See application file for complete search history.

(56) References Cited

U.S. PATENT DOCUMENTS

| | | | | | |
|---|---|---|---|---|---|
| 2,044,948 | A | * | 6/1936 | Leon | 439/362 |
| 3,441,799 | A | * | 4/1969 | Delafrange | 361/102 |
| 3,663,864 | A | * | 5/1972 | Carlson et al. | 361/799 |
| 3,786,312 | A | * | 1/1974 | Roussard | 361/643 |
| 4,000,444 | A | * | 12/1976 | Douglas et al. | 361/45 |
| 4,378,579 | A | * | 3/1983 | Hudson, Jr. | 361/45 |
| 4,567,544 | A | * | 1/1986 | Ronemus et al. | 361/753 |
| 4,799,124 | A | * | 1/1989 | Taylor et al. | 361/42 |
| 4,858,056 | A | * | 8/1989 | Russell | 361/98 |
| 5,099,212 | A | * | 3/1992 | Nagaishi | 324/508 |
| 5,109,316 | A | * | 4/1992 | Murphy | 361/643 |
| 5,161,240 | A | * | 11/1992 | Johnson | 361/42 |
| 5,443,400 | A | | 8/1995 | Brown et al. | |
| 5,579,201 | A | * | 11/1996 | Karageozian | 361/119 |
| 5,585,992 | A | * | 12/1996 | Wu | 361/45 |
| 5,694,280 | A | * | 12/1997 | Zhou | 361/45 |
| 5,742,466 | A | * | 4/1998 | Kram | 361/118 |
| 5,757,598 | A | | 5/1998 | Aromin | |
| 5,780,775 | A | | 7/1998 | Yu | |
| 5,788,521 | A | * | 8/1998 | Milan | 439/214 |
| 5,807,141 | A | * | 9/1998 | Sexton | 439/652 |
| 5,844,765 | A | * | 12/1998 | Kato et al. | 361/115 |
| 5,906,517 | A | * | 5/1999 | Crane et al. | 439/654 |
| 5,943,199 | A | * | 8/1999 | Aromin | 361/42 |
| 5,971,808 | A | * | 10/1999 | Chiang et al. | 439/654 |
| 5,999,384 | A | * | 12/1999 | Chen et al. | 361/42 |
| 6,406,308 | B1 | | 6/2002 | Wang | |
| 6,410,994 | B1 | | 6/2002 | Jones et al. | |
| 6,480,082 | B1 | * | 11/2002 | Aihara et al. | 335/202 |
| 6,678,131 | B2 | * | 1/2004 | Chapman et al. | 361/42 |

* cited by examiner

*Primary Examiner*—Neil Abrams
(74) *Attorney, Agent, or Firm*—Kriegsman & Kriegsman

(57) ABSTRACT

A power strip includes a power cord and a plastic casing mounted onto one end of the power cord. A plurality of outlets are disposed in the casing in a side-by-side relationship. A ground fault circuit interrupter (GFCI) is disposed in the casing and electrically connects the power cord to each of the plurality of outlets. The GFCI is self-contained and modular in form and comprises an outlet-free housing and GFCI circuitry disposed within the outlet-free housing. The GFCI circuitry includes an indicator light, a test button and a reset button which fittingly protrude through corresponding openings formed in both the outlet-free housing and the insulated casing. In use, power cord delivers current to each of the plurality of outlets. However, GFCI serves to interrupt the flow of current from the power cord to each of the plurality of outlets upon detecting a ground fault condition in the power cord.

17 Claims, 8 Drawing Sheets

POWER STRIP WITH SELF-CONTAINED GROUND FAULT CIRCUIT INTERRUPTER MODULE

BACKGROUND OF THE INVENTION

The present invention relates generally to a power strip and more particularly to a power strip which provides ground fault protection.

Power strips are well-known and are commonly used in the art to provide a plurality of ancillary outlets for a single conventional wall outlet.

Power strips are typically constructed to include an plastic or metal casing which is at least partially hollowed out so as to form an interior cavity. The casing is mounted onto a first end of a power cable, said power cable including a hot line, a neutral line and a ground line which are all wrapped together by an outer protective sheath. The second end of the power cable is typically in the form of plug which is adapted to connect with a conventional wall outlet.

Each outlet in the power strip includes a first female contact receptacle which is electrically connected to the hot line of the power cable and a second female contact receptacle which is electrically connected to the neutral line of the power cable. Each of the first and second female contact receptacles is disposed within the interior cavity and is accessible through an associated slotted opening formed in the top of the casing. Optionally, each outlet in the power strip may include a third female contact receptacle which is electrically connected to the ground line of the power cable, the third female contact receptacle being disposed within the interior cavity and accessed through an associated opening formed in the top of the casing.

As such, each outlet is adapted to receive the plug of a device, such as an electrical appliance, which receives current from a power source. Specifically, each contact receptacle of an outlet is adapted to receive an associated contact terminal of the plug. As a result, a current path is established between the outlet and the plug, thereby providing the device with the necessary power to operate.

A power switch is commonly mounted onto the casing and electrically connects the hot and neutral lines of the power cord with each of the individual outlets. As such, the power switch allows for manual regulation of the flow of current between the power cord and each of the individual outlets. The power switch may be provided with an internal circuit breaker which monitors the amount of current passing into and traveling out from the individual outlets. Whenever the amounts of incoming and outgoing current passing into and traveling out from a load connected to the power strip exceeds the current rating of the circuit breaker (thereby signifying a dangerous overcurrent condition) or if there is an accidental short circuit in the load, the circuit breaker opens, or trips, thereby instantaneously cutting off the flow of electricity to the load, which is highly desirable.

Power strips are also commonly provided with surge protection capabilities. Specifically, a surge protector is often disposed within the interior cavity of the casing and electrically connects the hot and neutral lines of the power cord with each of the individual outlets. Connected in this manner, the surge protector protects any load connected to the power strip from a power surge occurring at the wall outlet. A power surge (also commonly referred to as transient voltage) is an increase in the voltage at the wall outlet which is above the standard level (e.g., 120 volts). As can be appreciated, subjecting a load to a power surge can potentially damage and/or destroy the load, which is highly undesirable.

Although widely used in commerce, conventional power strips of the type described above suffer from a notable drawback. Specifically, although conventional power strips provide protection from power surges and overcurrent conditions, conventional power strips do not provide protection from ground fault conditions.

A ground fault condition occurs if the current in the hot line and the current in the neutral line have unequal values (e.g., if the hot line connects directly to ground). As will be described further below, a ground fault condition can be extremely dangerous to a person who is in contact with the load. Specifically, if someone accidentally touches (i.e., grounds) the hot line, the current level in the hot line will immediately become less than the current level in the neutral line. However, because the current path from the wall outlet to the load effectively functions as a closed circuit, the current level in the hot line will always adjust to the current level in the neutral line. As a result, once the hot line is grounded, the current level in the hot line will quickly surge to the current level in the neutral line. This surge in current in the hot line can potentially electrocute the person contacting the load, which is highly undesirable.

SUMMARY OF THE INVENTION

It is an object of the present invention to provide a new and improved power strip.

It is another object of the present invention to provide a power strip which provides ground fault protection.

It is yet another object of the present invention to provide a power strip as described above which includes a readily detectable indicator for notifying the user that the power strip has tripped in response to a ground fault condition.

It is still another object of the present invention to provide a power strip as described above which can be manually reset after the power strip has tripped in response to a ground fault condition.

It is yet still another object of the present invention to provide a power strip as described above which can be manually tripped for testing purposes.

It is yet another object of the present invention to provide a power strip as described above which may be mass produced, has a minimal number of parts, includes modular components, and can be easily assembled.

Accordingly, as one feature of the present invention, there is provided a power strip comprising a power cord comprising a hot line and a neutral line, a casing mounted onto said power cord, a plurality of outlets disposed in said casing, and a ground fault circuit interrupter (GFCI) disposed in said casing, said GFCI electrically connecting said power cord to each of said plurality of outlets, said GFCI regulating the flow of current between said power cord and said plurality of outlets.

As another feature of the present invention, there is provided a ground fault circuit interrupter (GFCI) for regulating the flow of current between a power source and a load, said GFCI comprising an outlet-free housing, and GFCI circuitry disposed in said outlet-free housing.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings wherein like reference numerals represent like parts.

DETAILED DESCRIPTION OF PREFERRED EMBODIMENTS

Figure 1:
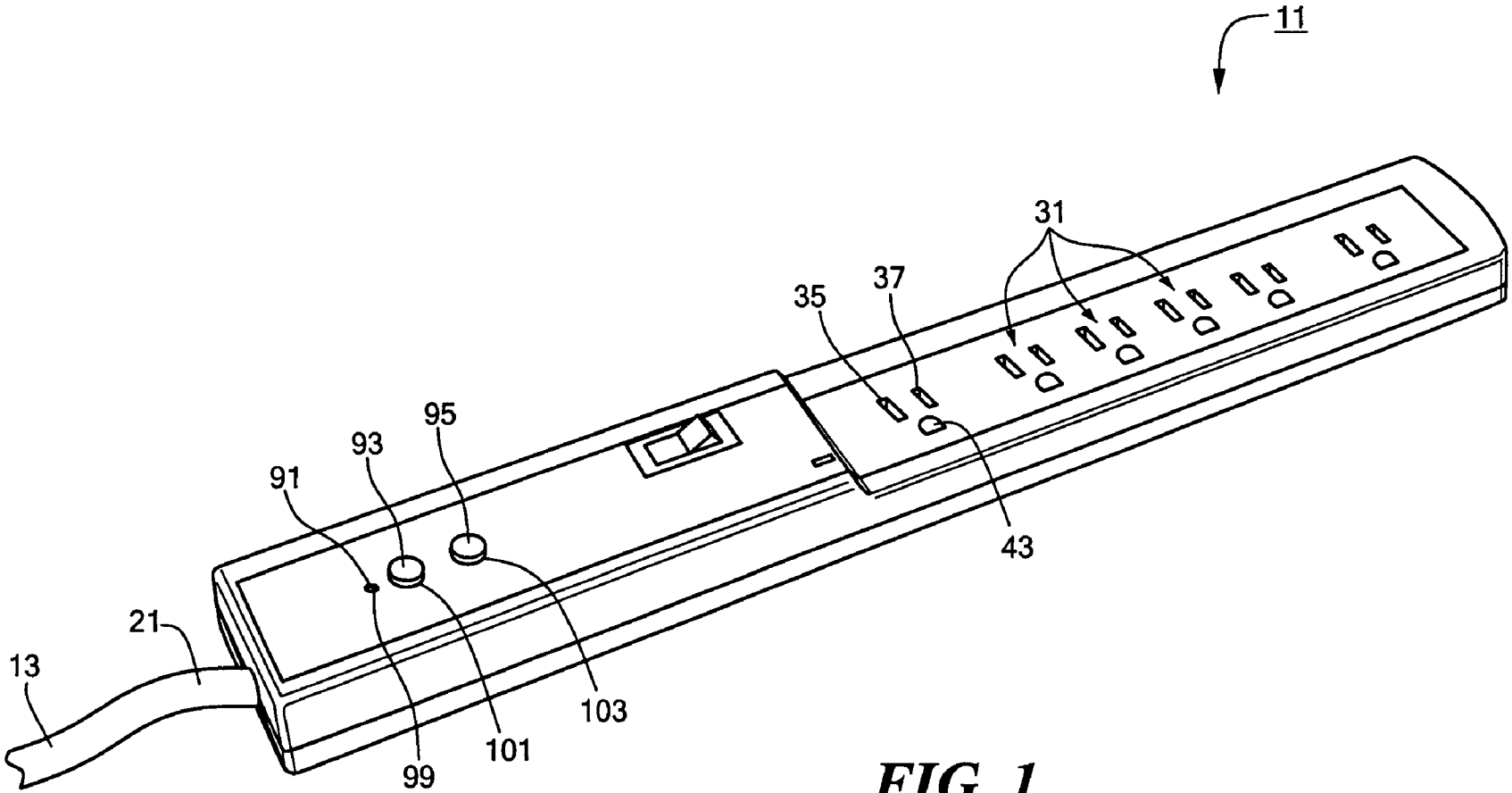
FIG. 1 is a top perspective view of a power strip constructed according to the teachings of the present invention.
Figure 2:
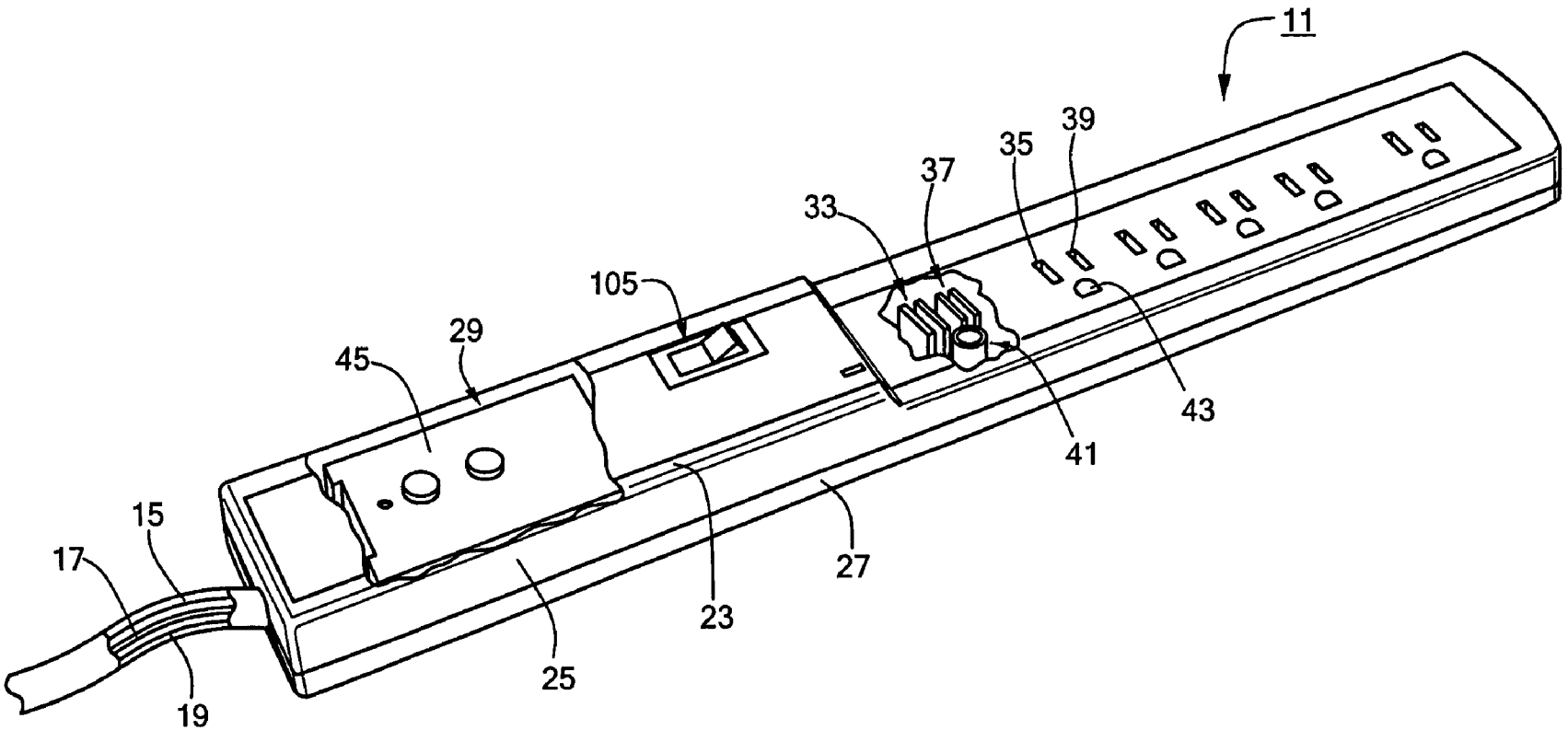
FIG. 2 is a top perspective view, broken away in part, of the power strip shown in FIG. 1.
Figure 3:
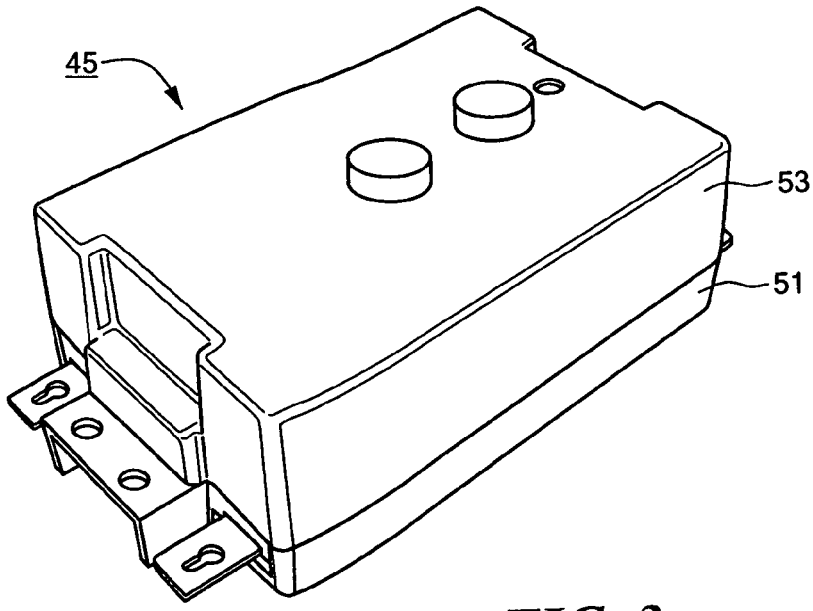
FIG. 3 is a side perspective view of the ground fault circuit interrupter shown in FIG. 2.
Figure 4:
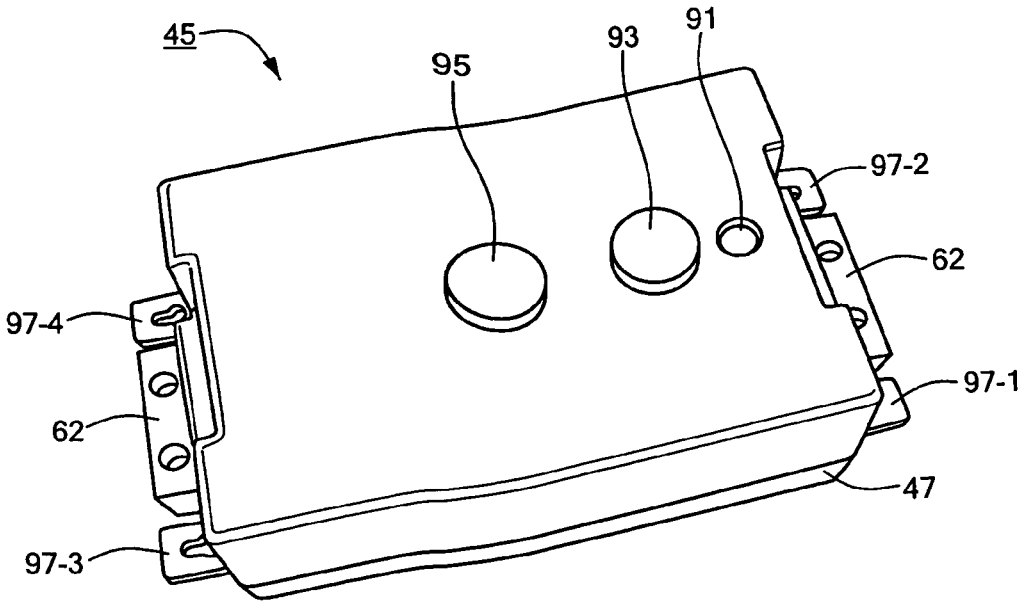
FIG. 4 is a top perspective view of the ground fault circuit interrupter shown in FIG. 2.
Figure 5:
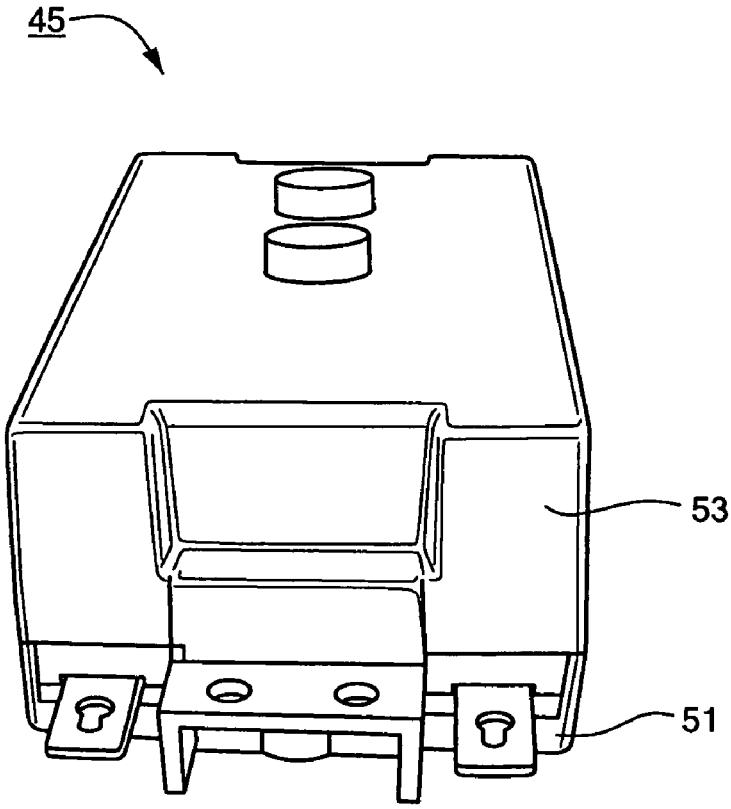
FIG. 5 is an end perspective view of the ground fault circuit interrupter shown in FIG. 2.

Referring now to FIGS. 1 and 2, there is shown a power strip constructed according to the teachings of the present invention, the power strip being represented generally by reference numeral 11. As will be described further in detail below, power strip 11 is constructed to provide ground fault protection.

Power strip 11 comprises a power cord 13. Power cord 13 is conventional in construction and includes a hot line 15, a neutral line 17 and a ground line 19 which are all wrapped together by an outer protective sheath 21 constructed of an insulated material.

A plastic casing 23 is mounted onto one end of power cord 13. The other end of power cord 13 is preferably in the form of a male plug (not shown) which can be inserted into a conventional electrical outlet. With the plug inserted into a conventional electrical outlet, electricity delivered into the electrical outlet travels through the plug, along the power cord 13 and into the various outlets of the power strip, as will be described further below.

Casing 23 comprises a bottom portion 25 and a top portion 27 which can be fixedly secured together by any conventional means (e.g., using screws, through snap-fit engagement between portions 25 and 27, etc.). Secured together, bottom portion 25 and top portion 27 together define an interior cavity 29 into which the primary electric components for power strip 11 are disposed.

Power strip 11 comprises a plurality of outlets 31 disposed in a side-by-side relationship, each outlet 31 being adapted to receive a conventional, three-terminal electric plug. Specifically, each outlet 31 includes a hot line female contact receptacle 33 which is electrically connected to hot line 15. Receptacle 33 is sized and shaped to conductively receive the hot line conductor blade of a standard electrical plug, receptacle 33 being accessed through a vertical, slot-shaped opening 35 formed in top portion 27 of casing 23. In addition, each outlet 31 includes a neutral line female contact receptacle 37 which is electrically connected to neutral line 17. Receptacle 37 is sized and shaped to conductively receive the neutral line conductor blade of a standard electrical plug, receptacle 37 being accessed through a vertical, slot-shaped opening 39 formed in the top portion 27 of casing 23. Furthermore, each outlet 31 includes a ground line female contact receptacle 41 which is electrically connected to ground line 19. Receptacle 41 is sized and shaped to conductively receive the ground pin of a standard electrical plug, receptacle 41 being accessed through a rounded opening 43 formed in the top portion 27 of casing 23. As can be appreciated, due to its connection to hot line 15, neutral line 17 and ground line 19, each outlet 31 is provided with the necessary current to power a load connected thereto.

It should be noted that the particular construction of each outlet 31 does not serve as a principal feature of the present invention. Rather, outlets 31 serve to represent any conventional outlet which is well known and widely used in the art. As such, outlets 31 could be replaced with any other type of conventional outlet without departing from the spirit of the present invention. For example, outlets 31 could be in the form of a conventional two-prong outlet (which does not include a receptacle for receiving a ground pin).

As seen most clearly in FIG. 2, a ground fault circuit interrupter (GFCI) 45 is disposed within casing 23. As will be described further in detail below, GFCI 45 connects hot and neutral lines 15 and 17 with each of the individual outlets 31. In this manner, GFCI 45 serves to interrupt the flow of current from power cord 13 and into each of the individual outlets 31 upon detecting a ground fault or grounded neutral condition in lines 15 and 17, which is highly desirable.

As will be described further in detail below, two novel features of power strip 11 relate to (1) the implementation of ground fault circuit interrupter 45 in power strip 11, and (2) the self-contained, modular construction of ground fault circuit interrupter 45.

Referring now to FIGS. 3–11, GFCI 45 comprises a outlet-free housing 47 and GFCI circuitry 49 disposed within housing 47.

Housing 47 is constructed of a durable and insulated material, such as plastic, and includes a bottom member 51 and a top member 53 which are releasably secured together using screws 55 or other suitable means (e.g., rivets or snap-in feature). Together, bottom member 51 and top member 53 define an interior cavity 56 which is sized and shaped to receive GFCI circuitry 49.

Figure 7:
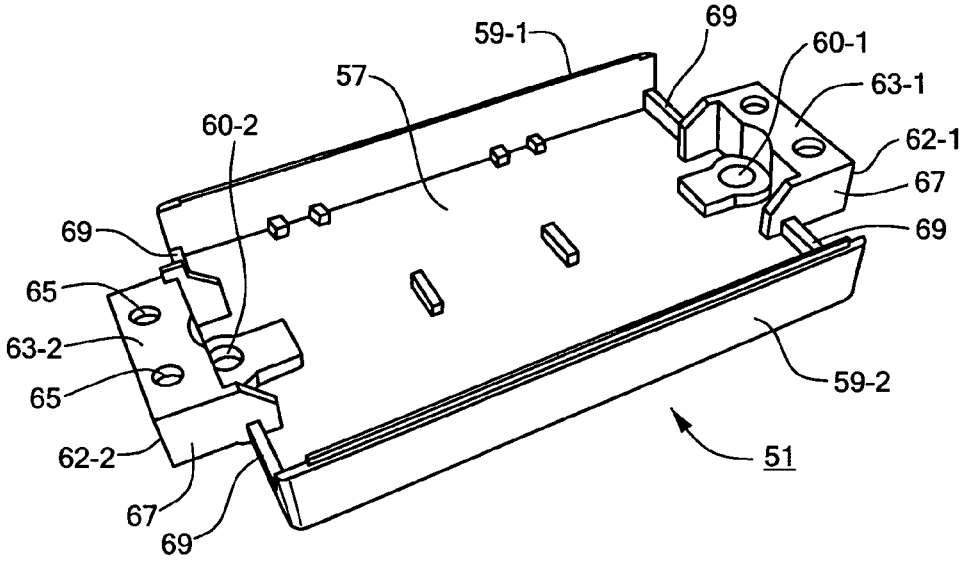
FIG. 7 is a top perspective view of the bottom member of the ground fault circuit interrupter shown in FIG. 3.
Figure 8:
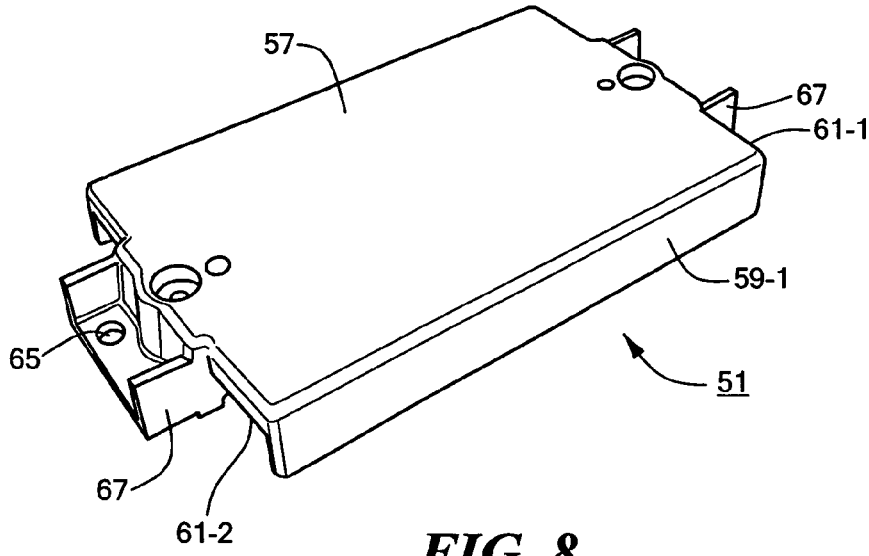
FIG. 8 is a bottom perspective view of the bottom member of the ground fault circuit interrupter shown in FIG. 3.

As seen most clearly in FIGS. 7 and 8, bottom member 51 is an integral piece which includes a substantially flat bottom panel 57 and a pair of sidewalls 59-1 and 59-2 which extend orthogonally up from opposite sides of bottom panel 57, thereby providing bottom member 51 with a generally U-shaped configuration in lateral cross-section. Bottom member 51 is shaped to include a pair of openings 60, one opening 60-1 being formed at one end 61-1 of bottom panel 57 and the other opening 60-2 being formed at the other end 61-2 of bottom panel 57. It should be noted that the outer surface of bottom panel 57 is countersunk around each opening 60 to receive the head of a screw.

A first mounting bracket 62-1 is formed onto bottom panel 57 at end 61-1 and a second mounting bracket 62-2 is formed onto bottom panel 57 at end 61-2, each bracket 62 being positioned at the approximate midpoint between sidewalls 59. Each bracket 62 includes a flat support surface 63 which is spaced slightly up from and lies parallel with bottom panel 57, surface 63-1 extending out and away from end 61-1 and surface 63-2 extending out and away from end 61-2. Each support surface 63 is shaped to define a pair of spaced apart mounting holes 65 which are sized and shaped to receive a device (e.g., a screw, nail, bolt, etc.) for fixedly mounting GFCI 45 onto casing 23.

Each bracket 62 is also shaped to include a pair of spaced apart support arms 67, each support arm 67 projecting orthogonally up from bottom panel 57 and extending at an angle parallel with sidewalls 59. As will be described further below, support arms 67 help retain circuitry 49 in place on bottom member 51. A pair of shortened end walls 69 project orthogonally up from bottom panel 57 on opposite sides of each bracket 62, each end wall 69 extending at a right angle relative to sidewalls 59.

Figure 10:
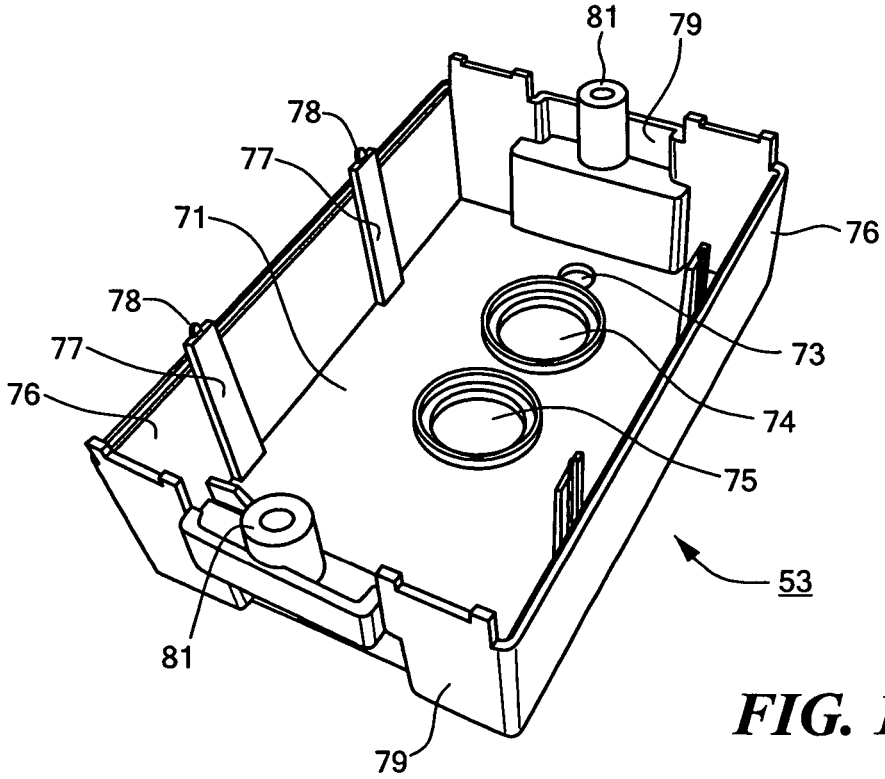
FIG. 10 is bottom perspective view of the top member of the ground fault circuit interrupter shown in FIG. 3.

As seen most clearly in FIG. 10, top member 53 is an integral piece which includes a substantially flat top panel 71. Top panel 71 is shaped to include a first circular opening 73, a second circular opening 74 and a third circular opening 75. As will be described further below, each of openings 73, 74 and 75 is sized and shaped to fittingly receive an associated component of GFCI circuitry 49.

A pair of sidewalls 76 extend orthogonally down from opposite sides of top panel 71, thereby providing top member 53 with a generally U-shaped configuration in lateral cross-section. A pair of spaced apart tabs 77 are formed onto the inner surface of each sidewall 73 and project downward away from top panel 71. Each tab 75 includes a longitudinally extending rib 78 which is substantially circular in lateral cross-section.

A pair of end walls 79 extend orthogonally down from opposite ends of top panel 71, thereby providing top member 53 with a generally U-shaped configuration in longitudinal cross-section. A threaded boss 81 is formed onto the inner surface of each end wall 79, the free end of each boss 81 projecting downward away from top panel 71.

Figure 11:
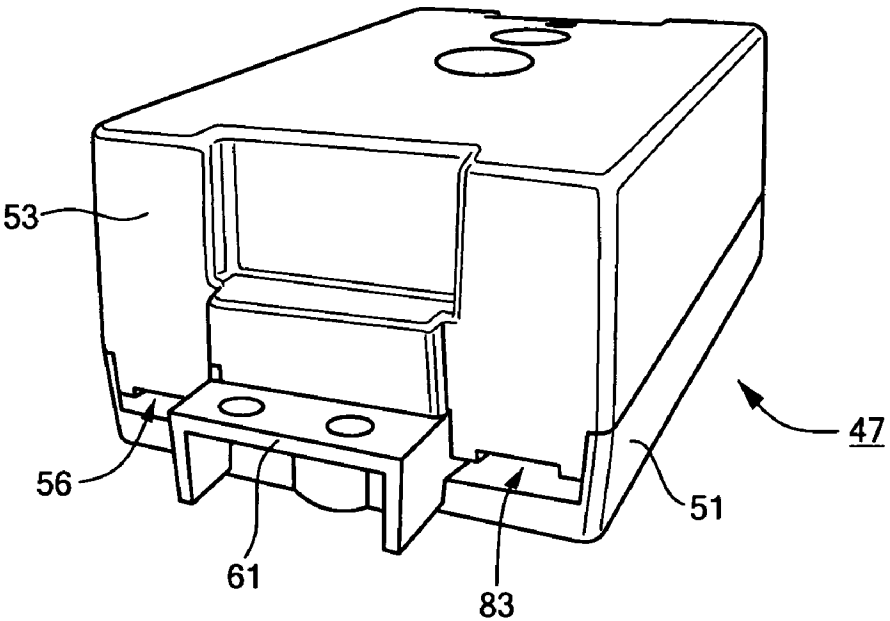
FIG. 11 is an end perspective view of the outlet-free housing for the ground fault circuit interrupter shown in FIG. 3.

It should be noted that, with top member 53 mounted onto bottom member 51, top member 53 and bottom member 51 together define a pair of lateral slots 83 on opposite sides of each bracket 61, as seen most clearly in FIG. 11. As will be described further below, each slot 83 is sized and shaped to receive an associated contact terminal of GFCI circuitry 49.

GFCI circuitry 49 represents any conventional GFCI circuitry. As an example, GFCI circuitry 49 may be of the type disclosed in U.S. Pat. No. 5,757,598, which is incorporated herein by reference.

Figure 6:
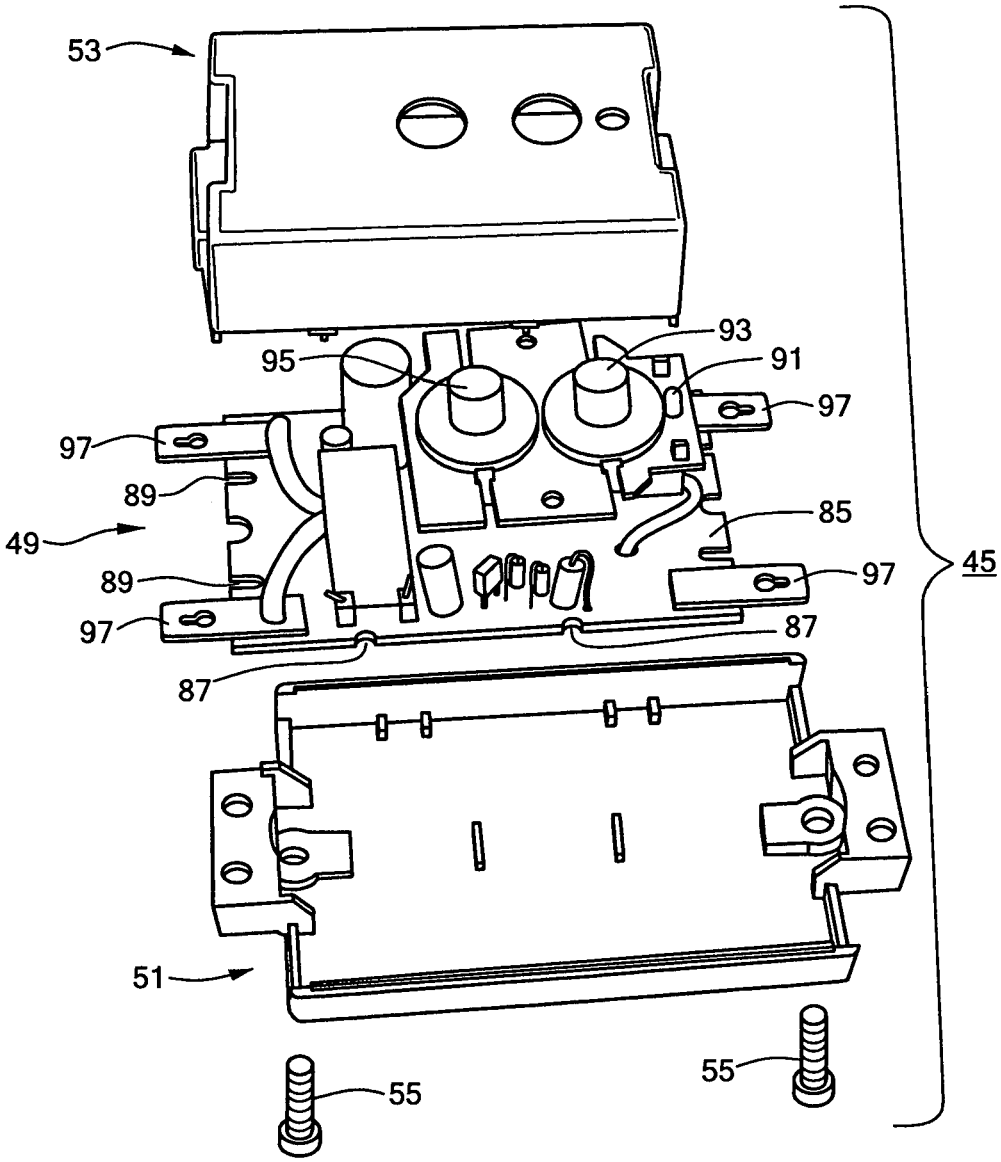
FIG. 6 is an exploded perspective view of the ground fault circuit interrupter shown in FIG. 2.

As seen most clearly in FIG. 6, GFCI circuitry 49 includes a main printed circuit board 85 onto which various circuit components are mounted. Each side of main printed circuit board 85 is shaped to include a pair of semi-circular notches 87, each notch 87 being sized and shaped to fittingly receive an associated rib 78 from top member 53. Furthermore, each end of main printed circuit board 85 is shaped to include a pair of longitudinally-extending slots 89, each slot 89 being sized and shaped to fittingly receive an associated support arm 67.

Figure 9:
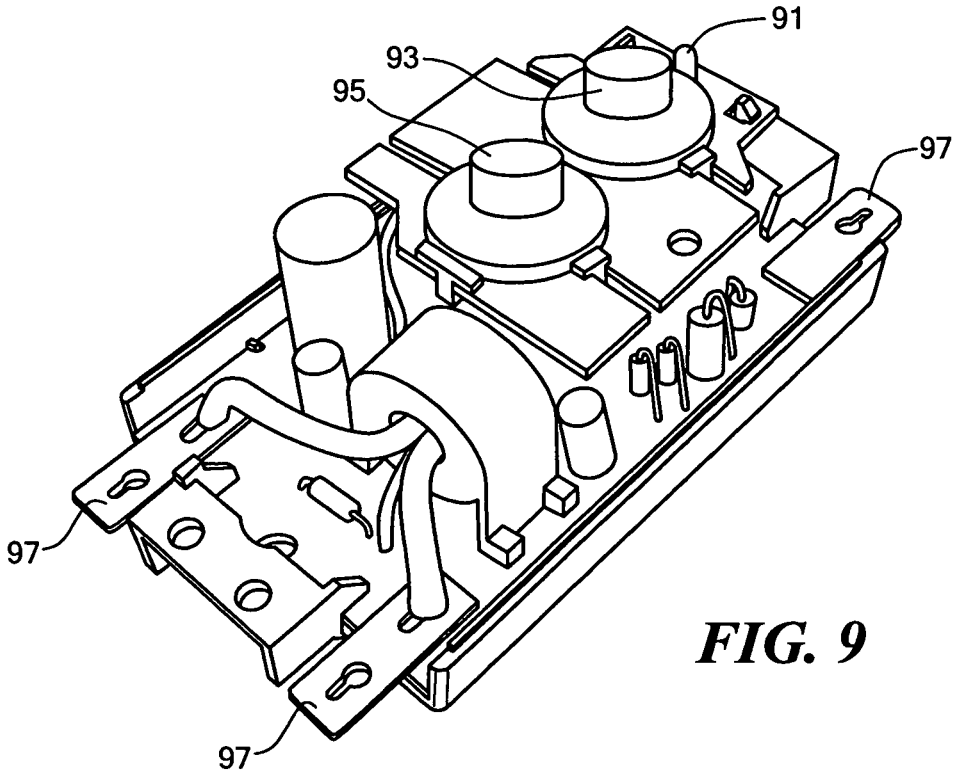
FIG. 9 is a top perspective view of the ground fault circuit interrupter shown in FIG. 3, the ground fault circuit interrupter being shown with its top member removed therefrom.

As such, with GFCI 45 assembled together, arms 67 project into slots 89 to secure GFCI circuitry 49 securely in place on bottom member 51, as seen most clearly in FIG. 9. Furthermore, with GFCI 45 assembled together, tabs 77 abut against the inner surface of sidewalls 59 to secure top member 53 in place on bottom member 51 and ribs 78 project into notches 87 to secure main printed circuit board 85 fixed in place in relation to top member 53.

GFCI circuitry 49 also includes an indicator light 91 which is sized and shaped to fittingly protrude through opening 73 in top member 53 when GFCI 45 is in its assembled form. In use, GFCI circuitry 49 is designed in such a manner so that indicator light 91 will illuminate when circuitry 49 detects a ground fault or grounded neutral condition. Preferably, indicator light 91 is in the form of a light emitting diode. However, it is to be understood that indicator light 91 could be in the form of an alternative illuminating device which is well-known in the art without departing from the spirit of the present invention.

GFCI circuitry 49 also includes a test button 93 which is sized and shaped to fittingly protrude through opening 74 in top member 53 when GFCI 45 is in its assembled form. In use, the depression of test button 93 allows the user to trip circuitry 49 in ensure that GFCI 45 is providing proper ground fault protection.

GFCI circuitry 49 further includes a reset button 95 which is sized and shaped to fittingly protrude through opening 75 in top member 53 when GFCI 45 is in its assembled form. In use, the depression of reset button 95 serves to reset circuitry 49 after a trip condition is experienced.

GFCI circuitry 49 additionally includes four, blade-shaped, terminal contacts 97, each contact 97 being sized and shaped to fittingly protrude through an associated lateral slot 83 formed between top member 53 and bottom member 51. Terminal contact 97-1 is designated for electrical connection with the hot line 15 of the power source (i.e., power cord 13). Terminal contact 97-2 is designated for electrical connection to the neutral line 17 of the power source (i.e., power cord 13). Terminal contact 97-3 is designated for electrical connection to the hot line of the load (i.e., each outlet 31). Terminal contact 97-4 is designated for electrical connection to the neutral line of the load (i.e., each outlet 31).

As can be seen most clearly in FIG. 1, top portion 25 of casing 23 includes a first circular opening 99, a second circular opening 101 and a third circular opening 103. With power strip 11 constructed into its assembled form, GFCI 45 is disposed between top portion 25 and bottom portion 27 of casing 23 in such a manner so that light 91 protrudes through opening 99, test button 93 protrudes through opening 101, and reset button 95 protrudes through opening 103, thereby providing the consumer with suitable access to the necessary components of GFCI 45.

A combination power switch and circuit breaker 105 is preferably disposed within casing 23. Combination power switch/circuit breaker 105 is preferably disposed in the current path between GFCI 45 and each of individual outlets 31. In this manner, power switch/circuit breaker 105 can be used to: (1) manually regulate the flow of current between power cord 13 and outlets 31 (by means of the power switch) and (2) automatically interrupt current passing into outlets 31 when the current levels passing into and traveling out from outlets 31 exceeds a predetermined current rating (by means of the circuit breaker). As can be appreciated, the inclusion of combination power switch/circuit breaker 105 does not serve as a novel feature of the present invention. Accordingly, it is to be understood that any conventional combination power switch and circuit breaker could be used in power strip 11 without departing from the spirit of the present invention.

As can be appreciated, the self-contained, modular construction of GFCI 45 provides a number of significant advantages.

As a first advantage, due to its self-contained, modular construction, GFCI 45 does not need to be manufactured in conjunction with the device into which it is disposed (i.e., remainder of power strip 11). Rather, GFCI 45 could be manufactured independently of the remainder of power strip 11. As a result, it is to be understood that GFCI 45 could be inexpensively and efficiently mass produced and subsequently sold to the manufacturer of any electric device that requires ground fault protection, thereby increasing the range of its potential applications, which is highly desirable.

As a second advantage, due to its self-contained, modular construction, GFCI 45 can provide open neutral protection (i.e., circuit protection when the neutral line is cut or otherwise opened) whereas traditional GFCIs do not provide open neutral protection.

As a third advantage, due to its self-contained modular construction, GFCI 45 can be constructed without a relay circuit whereas traditional GFCIs require a relay circuit. The ability to eliminate the relay circuit from circuitry 49 of GFCI 45 simplifies the manufacturing process and reduces costs, which is highly desirable.

As noted briefly above, the modular, self-contained construction of GFCI 45 allows it to be used in a wide variety of potential applications. In particular, GFCI 45 can be individually manufactured and sold for use in conjunction with any device that receives current from a power source.

Figure 12:
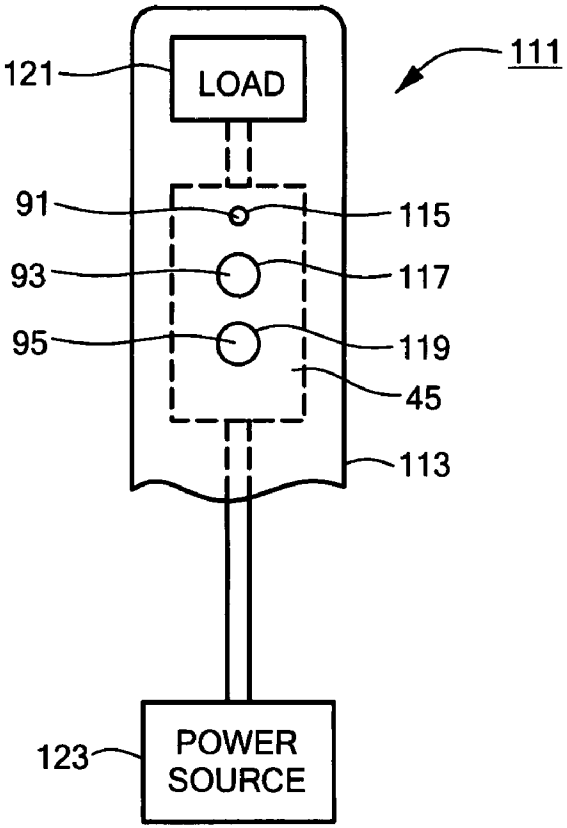
FIG. 12 is a fragmentary plan view of a device for receiving electrical power, said device being constructed according to the teachings of the present invention.

Specifically, referring now to FIG. 12, there is shown a fragmentary plan view of a device for receiving electrical power (such as a stake light), said device being constructed according to the teachings of the present invention and identified generally by reference numeral 111. Device 111 comprises a protective housing 113 which is at least partially hollowed to allow GFCI 45 to be disposed therewithin. Preferably, housing 113 includes a first circular opening 115 which is sized and shaped to enable light 91 of GFCI 45 to fittingly project therethrough, a second circular opening 117 which is sized and shaped to enable test button 93 of GFCI 45 to fittingly project therethrough and a third circular opening 119 which is sized and shaped to enable reset button 95 of GFCI 45 to fittingly project therethrough. As such, the consumer is provided with the necessary access to the buttons and displays of GFCI, which is highly desirable. In use, GFCI 45 connects the load 121 of device 111 with a power source 123.

The versions of the present invention described above are intended to be merely exemplary and those skilled in the art shall be able to make numerous variations and modifications to it without departing from the spirit of the present invention. All such variations and modifications are intended to be within the scope of the present invention as defined in the appended claims. For example, it should be noted that the particular components which make up the aforementioned embodiments may be interchanged or combined to form additional embodiments.

What is claimed is:

1. A power strip comprising:

(a) a power cord comprising a hot line and a neutral line, (b) an insulated casing mounted onto said power cord, said casing being shaped to define a first opening, (c) a plurality of outlets at least partially disposed in said casing, and (d) a self-contained and modular ground fault circuit interrupter (GFCI) at least partially disposed in said casing, said GFCI electrically connecting said power cord to each of said plurality of outlets, said GFCI regulating the flow of current between said power cord and said plurality of outlets, said GFCI interrupting the flow of current from said power cord to each of said plurality of outlets upon detecting a ground fault condition in the hot and neutral lines, said GFCI comprising, (i) an outlet-free housing, said outlet-free housing being shaped to define a first opening, (ii) ground fault circuit interrupter (GFCI) circuitry disposed in said outlet-free housing, said GFCI circuitry including an externally-accessible reset button which is sized and shaped to at least partially protrude through the first opening in said outlet-free housing and through the first opening in said casing, (iii) a first pair of contacts electrically coupled to said GFCI circuitry, said first pair of contacts being accessible externally of said housing, and (iv) a second pair of contacts electrically coupled to said GFCI circuitry, said second pair of contacts being accessible externally of said housing.

2. The power strip of claim 1 wherein said insulated casing is shaped to define an interior cavity.

3. The power strip of claim 2 wherein said plurality of outlets and said GFCI are at least partially disposed within the interior cavity of said casing.

4. The power strip of claim 3 wherein each outlet comprises a first female contact receptacle electrically connected to the hot line of said power cord, a second female contact receptacle electrically connected to the neutral line of said power cord and a third female contact receptacle electrically connected to the ground line of said power cord.

5. The power strip of claim 4 wherein each of the first, second and third female contact receptacles of each outlet is externally accessible through an associated receptacle opening formed in said insulated casing.

6. The power strip of claim 5 wherein the outlet-free housing of said GFCI is shaped to define an interior cavity.

7. The power strip of claim 6 wherein the outlet-free housing of said GFCI comprises a bottom member and a top member which are secured together.

8. The power strip of claim 7 wherein the outlet-free housing of said GFCI comprises at least one mounting bracket.

9. The power strip of claim 1 wherein the outlet-free housing of said GFCI is shaped to define a a second opening and a third opening.

10. The power strip of claim 9 wherein said GFCI circuitry comprises a ground fault condition indicator light which is sized and shaped to at least partially protrude through the second opening in the outlet-free housing of said ground fault circuit interrupter.

11. The power strip of claim 9 wherein said GFCI circuitry comprises a ground fault condition test button which is sized and shaped to at least partially protrude through the third opening in the outlet-free housing of said ground fault circuit interrupter.

12. The power strip of claim 11 wherein said casing is shaped to define a second opening, the ground fault condition test button being sized and shaped to at least partially protrude through the second opening in the insulated casing.

13. The power strip of claim 1 wherein each of said first and second pairs of contacts is sized and shaped to at least partially protrude through a corresponding slot formed in the outlet-free housing of said ground fault circuit interrupter.

14. The power strip of claim 1 wherein said insulated casing is mounted onto one end of said power cord.

15. The power strip of claim 1 wherein said insulated casing comprises a bottom portion and a top portion which are secured together.

16. The power strip of claim 1 wherein said power cord further comprises a ground line.

17. A ground fault circuit interrupter (GFCI)-protected device, said device receiving current from a power source, said device comprising:

(a) an insulated casing, said insulated casing being shaped to define a first opening (b) a load, and (c) a ground fault circuit interrupter (GFCI) at least partially disposed within said casing, said GFCI regulating the flow of current from said power source to said load, said GFCI comprising, (i) an outlet-free housing, said outlet-free housing being shaped to define a first opening, (ii) GFCI circuitry disposed within the outlet-free housing, said GFCI circuitry including an externally-accessible reset button which is sized and shaped to at least partially protrude through the first opening in said outlet-free housing and through the first opening in said casing, (iii) a first pair of contacts electrically coupled to said GFCI circuitry, said first pair of contacts being accessible externally of said housing, said first pair of contacts being adapted to be electrically coupled to said power source, and (iv) a second pair of contacts electrically coupled to said GFCI circuitry, said second pair of contacts being accessible externally of said housing, said second pair of contacts being adapted to be electrically coupled to said load.

* * * * *